US008314556B2

(12) United States Patent
Handa

(10) Patent No.: US 8,314,556 B2
(45) Date of Patent: Nov. 20, 2012

(54) MAGNETRON

(75) Inventor: Takanori Handa, Tochigi (JP)

(73) Assignee: Panasonic Corporation, Osaka (JP)

( * ) Notice: Subject to any disclaimer, the term of this patent is extended or adjusted under 35 U.S.C. 154(b) by 811 days.

(21) Appl. No.: 12/368,776

(22) Filed: Feb. 10, 2009

(65) Prior Publication Data

US 2009/0236989 A1 Sep. 24, 2009

(30) Foreign Application Priority Data

Mar. 19, 2008 (JP) ..... P2008-070912

(51) Int. Cl.
*H01J 25/50* (2006.01)

(52) U.S. Cl. ..... 315/39.51; 315/39

(58) Field of Classification Search ..... None
See application file for complete search history.

(56) References Cited

U.S. PATENT DOCUMENTS

| | | | | |
|---|---|---|---|---|
| 4,132,921 | A * | 1/1979 | Hatayama et al. | 315/39.51 |
| 4,558,250 | A * | 12/1985 | Tsuzurabara | 313/337 |
| 4,733,124 | A * | 3/1988 | Oguro et al. | 313/341 |
| 5,394,060 | A * | 2/1995 | Yoon | 315/39.51 |
| 6,844,680 | B2 * | 1/2005 | Yoshihara et al. | 315/39.51 |
| 7,696,697 | B2 * | 4/2010 | Kuwahara et al. | 315/39.51 |

FOREIGN PATENT DOCUMENTS

| | | |
|---|---|---|
| JP | 55-059635 | 5/1980 |
| JP | 60-163339 | 8/1985 |
| JP | 61-18610 | 2/1986 |
| JP | 01-045042 | 2/1989 |
| JP | 04-082137 | 3/1992 |
| JP | 10-055761 | 2/1998 |
| JP | 10-055762 | 2/1998 |
| JP | 11-306997 | 11/1999 |
| JP | 2000-306518 | 11/2000 |

OTHER PUBLICATIONS

European Search Report issued in European Patent Application No. EP 09152342.3 dated Mar. 16, 2010.

* cited by examiner

*Primary Examiner* — Shawki S Ismail
*Assistant Examiner* — Crystal L Hammond
(74) *Attorney, Agent, or Firm* — McDermott Will & Emery LLP

(57) ABSTRACT

The present invention aims to provide a magnetron in which the getter material is used under the temperature range in which the gettering effect is sufficiently exerted, and even if the getter material evaporates, the vapor of the getter material is not vapor-deposited on the stem ceramic and the antenna ceramic, and therefore, unwilling electrical conduction or performance deterioration is prevented. The magnetron according to the present invention includes an anode cylinder having a cylindrical shape with open side ends and including an inner wall and a plurality of anode vane radially provided on the inner wall, a cathode part provided on a central axis of the anode cylinder, a pair of pole piece, one of which is provided on the one of the open side end and the other one of which is provided on the other open side end, a mounting part provided in the anode cylinder as a different part from the pole piece, and a getter material provided on the mounting part.

15 Claims, 6 Drawing Sheets

MAGNETRON

BACKGROUND OF INVENTION

This invention is related to a magnetron suitable for a micro wave generator of a micro wave application apparatus.

Generally, a magnetron has a getter material for sustaining and obtaining a high degree of vacuum in the chamber. The getter material is formed from mainly titanium powder, zirconium powder or combination of them which are dissolved into a solvent and sintered. Just after sintering the getter material in the chamber, the surface of the getter material is oxidized, in other words, the surface condition is in a state of having adsorbed gases. Under this condition, when the temperature of the getter material reaches to a certain degree, the oxide or the like on the surface are dispersed in the chamber and a new gettering surface is reproduced. (This process is called "activation"). This new gettering surface adsorbs gas molecules. Such gettering effect can be obtained at low temperature (at room temperature). But, in the low temperature condition, as the speed of adsorbents diffusion into the chamber is slower than the speed of adsorbing, the gettering surface is saturated and the gettering effect become not to work. On the other hand, when the getter material gets too high temperature, the getter material melts and evaporates.

As mentioned above, there is a suitable temperature range for effective work of the getter material. The position at which the getter material is mounted is determined in view of the temperature range. For example, in the magnetron disclosed in JP-U-S61-018610 as shown in FIG. 9, a getter material 103 is mounted on an inclined surface of a pole piece 102 mounted on an opening edge of an input side of an anode cylinder 101. The inclined surface is facing to the inner wall of the anode cylinder 101 and electricity is supplied for the cathode part 106 through the input side of the anode cylinder 101. In this reference, such a method is employed in which the getter material 103 is applied to the inclined surface of the pole piece 102 and then sintered, and alternatively in which a getter substrate coated by the getter material 103 is welded on the inclined surface of the pole piece 102. In FIG. 9, a pole piece 104 mounted on the opening edge of the output side of the anode cylinder 101, an anode vane 105 radially disposed inside the anode cylinder 101, a stem ceramic 107 supporting two cathode lead 108*a* and 108*b* of the cathode part 106, an antenna lead 109, and an antenna ceramic 110 are provided.

In a magnetron disclosed in JP-P-2000-306518, a method in which the getter material 103 is filled between the cathode lead 108*b* and the metal sleeve 111 swaged to the cathode lead 108*b* in order to prevent axial movement of the ceramic 130 which supports the two cathode leads 108*a*, 108*b* forming the cathode part as shown in FIG. 10 and a method in which the getter material is applied to the surface of the cathode lead 108*a* between the cathode side end hat 112 and the ceramic 130 as shown in FIG. 11, are adopted. These two methods can be adopted at the same time (that is, the combination of filling the getter material into the metal sleeve 111 and applying the getter material to the surface of the cathode lead 108*a*). In addition, the getter material 103 may be applied to the surface of the anode side end hat 113.

When the getter material is applied to or sintered on the pole piece like the magnetron disclosed in U-S61-018610, however, the gettering effect is exerted sufficiently because of relatively low temperature of the pole piece. Typically, the temperature of the pole piece is about 200 degree Celsius at a maximum.

When the getter material is filled in or applied to the lead lines or the anode side end hat similarly to the magnetron disclosed in P-2000-306518, the temperature of the getter material is kept in high due to its position close to the filament. Typically, the filament temperature is about 1700 degree Celsius. In this case, although this high temperature is effective for activation of the getter material, the melting point of the getter material such as titanium and zirconium should be considered. As the melting point under $10^{-6}$ Pa condition according to the vapor pressure curve is about 1000 degree Celsius for titanium and 1300 degree Celsius for zirconium, the getter material filled in or applied to the lead line may evaporate due to thermal conduction from the filament. Once the getter material evaporates, the performance of the magnetron is dramatically deteriorated. Especially, when the getter material filled in or applied to the lead line and the end hat evaporates, the getter material is vapor-deposited to the stem ceramic and the antenna ceramic for insulation and therefore unwilling electrical conductions are possibly caused.

The present invention is achieved in view of above mentioned problems. The object of the invention is providing a magnetron which works in the temperature range suitable for efficient work of the getter material and which has stable electrical character and performance even when the getter material evaporates and the stem ceramic and the antenna ceramic are vapor-deposited.

SUMMARY OF THE INVENTION

The first configuration of the magnetron according to the present invention includes an anode cylinder having a cylindrical shape with open side ends and including an inner wall and a plurality of anode vane radially provided on the inner wall, a cathode part provided on a central axis of the anode cylinder, a pair of pole piece one of which is provided on the one of the open side end and the other one of which is provided on the other open side end, and a mounting part provided in the anode cylinder as a different part from the pole piece, and a getter material provided on the mounting part.

Preferably, the mounting part is mounted on the pole piece.

Preferably, the mounting part is formed from a non-magnetic material.

Preferably, the mounting part has a ring-shape and the getter material is provided on a surface of the pole piece facing to the pole piece.

Preferably, the pole piece has a funnel shape with a through hole.

Preferably, the pole piece of the funnel shape includes a small circular plane, a large circular plane, and an inclination part connecting the small circular plane and the large circular plane. The through hole penetrates the small and the large circular plane.

Preferably, the mounting part is engaged with the small circular plane.

Preferably, the mounting part is engaged with the inclination part.

Preferably, the mounting part has an outer periphery bended at right angle.

Preferably, the mounting part has a plurality of protrusions on a surface facing to the pole piece at regular interval.

Preferably, the mounting part has a tapered shape and includes a first opening with a small radius and a second opening with a large radius. The getter material is provided on an outer peripheral surface of the mounting part.

According to the first configuration, as the thermal radiation from the filament efficiently heats the getter material, the getter material is able to work in the thermal range in which the gettering effect efficiently works.

For example, preferably the mounting part is mounted on the pole-piece. By mounting the mounting part on the pole piece, it is possible to set the getter material in a space surrounded by the pole piece and the anode vane. Because the effect of processes such as filament activation is small in the space surrounded by the pole piece and the anode vane, the getter material does not melt or evaporate during the processes. Even if the getter material evaporates, the vapor of the getter material hardly diffuses to the stem ceramic supporting the cathode lead and to the antenna ceramic due to the position of the mounting part. Therefore, the getter material is not vapor-deposited on the stem ceramic and the antenna ceramic, and unwilling electrical conduction or performance deterioration is prevented. The mounting part can be mounted on the anode cylinder.

Incidentally, when the mounting part is mounted on the pole piece, a non-magnetic material is suitable as a material for the pole piece. Forming the mounting part from a non-magnetic material, the distribution of magnetic flax is not disturbed. Conventional examples of the non-magnetic materials are copper and aluminum. Both materials have efficient thermal conductivity, but aluminum is not applicable inside high-temperature vacuum condition. Therefore, copper is conventionally used.

Applying above described magnetron to a micro wave application apparatus, high performance is obtained.

According to the magnetron of the present invention, the getter material works in the temperature range in which the gettering effect efficiently works. In addition, even if the getter material evaporates, unwilling electrical conduction or performance deterioration due to vapor-deposition of the getter material on the stem ceramic or the antenna ceramic is prevented.

DETAIL DESCRIPTION OF THE PREFERRED EMBODIMENTS

In the following, embodiments of the present invention are explained with referring to drawings.

Figure 1:
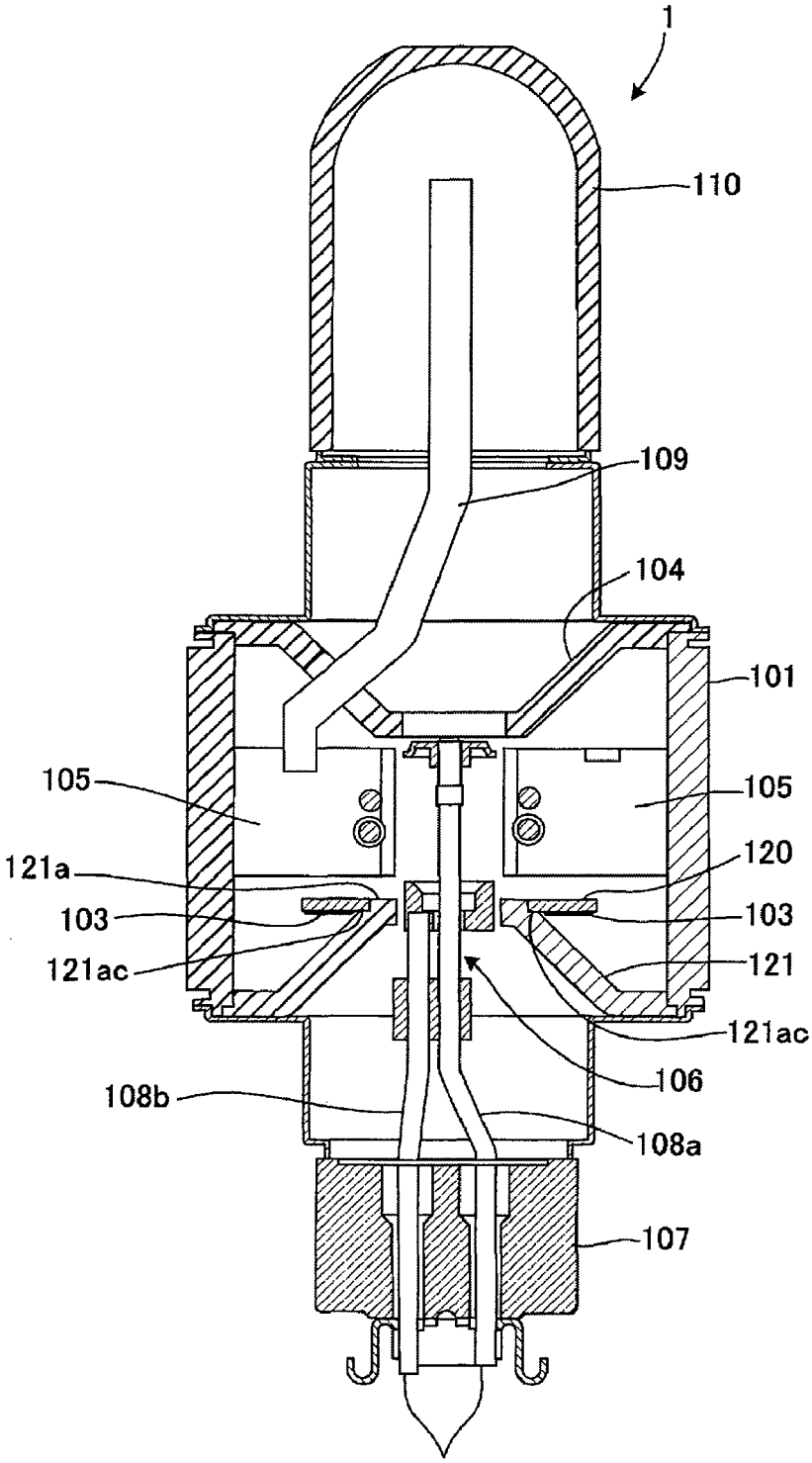
FIG. 1 is a vertical sectional view of the magnetron according to an embodiment of the present invention.

FIG. 1 shows a vertical sectional view of the magnetron according to the embodiment of the invention. In FIG. 1, the common parts shown in FIG. 1 and FIG. 9 have same reference numbers. The magnetron 1 according to this embodiment has a mounting part 120 having a getter material 103 on one side of a mounting part 120. A mounting part 120 is provided on a pole piece 121 provided on an input side opening end of an anode cylinder 101. Here, input side means a side on which electricity is supplied for the cathode part.

Figure 2:
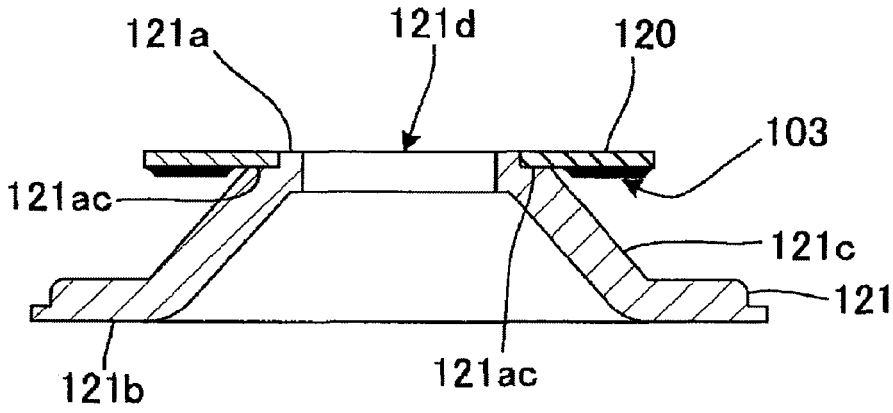
FIG. 2 is a vertical sectional view of the pole piece and the mounting part of the magnetron according to the embodiment.
Figure 3:
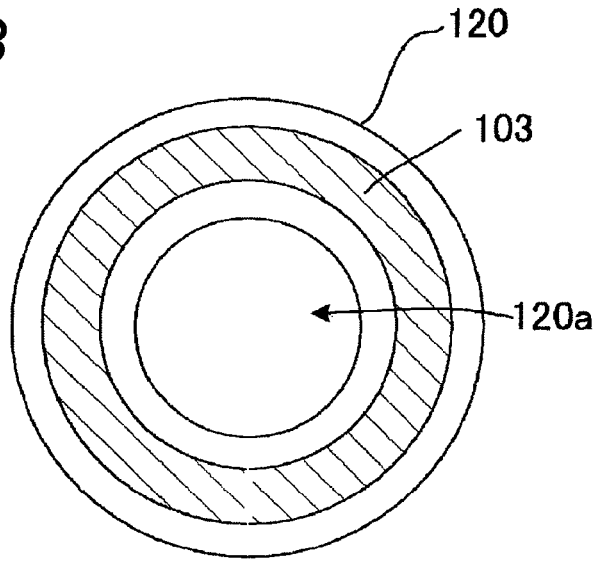
FIG. 3 is a plan view of the back side of the mounting part of the magnetron according to the embodiment.

FIG. 2 is an expanded sectional view showing the mounting part 120 and pole piece 121. FIG. 3 is a plan view of the mounting part 120. As shown in FIG. 2, the funnel-shaped pole piece 121 has a small circular plane 121*a* on the center of which a through hole 121*d* is provided, a large circular plane 121*b* which is larger than that of the small circular plane 121*a* in radius, and an inclination part of circular cone shape 121*c* connecting the small circular plane 121*a* to the large circular plane 121*b*. In addition, a cut-out portion 121*ac* is formed along the periphery of the small circular plane 121*a*.

The mounting part 120 is formed in a plane ring shape as shown in FIG. 3. The through hole 120*a* of the mounting part 120 is formed in a suitable size so as to be engaged with the cut-out portion 121*ac* (see FIG. 2). By engaging and fixing the mounting part 120 with the cut-out portion 121*ac*, the mounting part is mounted so as to be perpendicular to the central axis of the anode cylinder (perpendicular to the axial direction).

The getter material 103 is provided along a periphery of an input side surface of the mounting part 120. Here the input side surface of the mounting part 120 is a surface opposing to the pole piece 121 and, hereinafter, called as the back surface. As methods of providing the getter material 103 onto the mounting part 120, a method of applying the getter material 103 to the back surface and sintering the getter material, a method of molding a getter substrate, applied by the getter material 103, on the back side, and a method of forming the mounting part 120 from two thin rings and filling the getter material therebetween, can be employed. However, the providing method is not limited to theses methods and any method which can provide the getter material onto the mounting part is applicable. C-A3

The mounting part 120 is formed from a non-magnetic material such as copper so that the magnetic flux distribution is not disturbed by mounting the mounting part 120 onto the pole piece and the thermal radiation from the filament is efficiently transferred to the getter material 103. As the mounting part 120 is provided so as to be perpendicular to the central axis of the anode cylinder 101, the mounting part 120 receives the thermal radiation from filament as a whole. Therefore, the temperature of the mounting part 120 is set to be in a range in which the gettering effect of the getter material 103 is exerted sufficiently.

Figure 9:
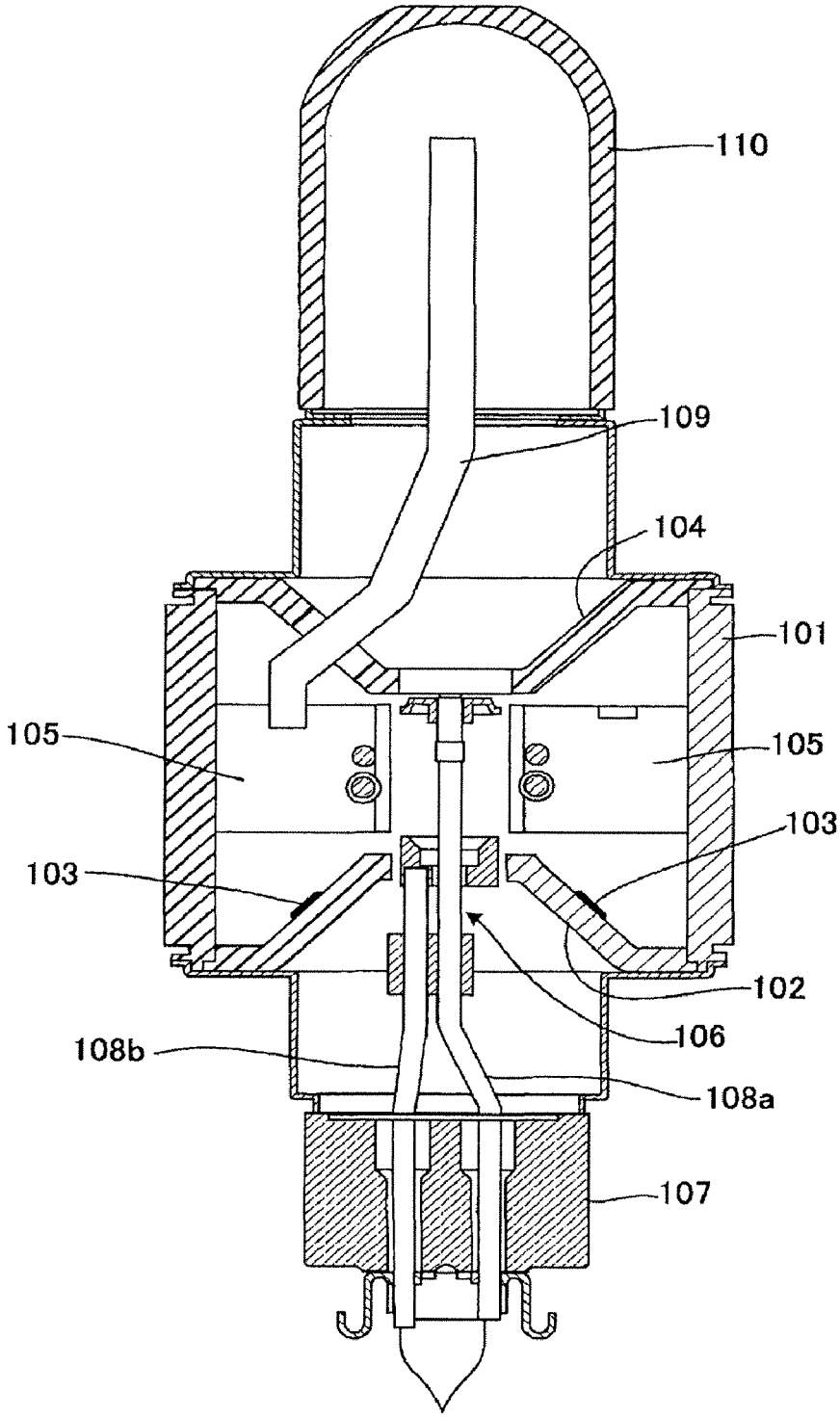
FIG. 9 PRIOR ART
FIG. 9 is a vertical view of the related magnetron.

Incidentally, in the related magnetron shown in FIG. 9, as the getter material 103 is provided on the inclined surface of the pole piece, the getter material 103 is not able to efficiently receive the thermal radiation from the filament. In the present invention, the getter material receives the thermal radiation from the filament efficiently. Therefore, even if the getter material 103 is provided on a position comparable to the position in the related art, it is possible that the getter material 103 works in the temperature range in which the gettering effect of the getter material 103 is exerted sufficiently.

Figure 10:
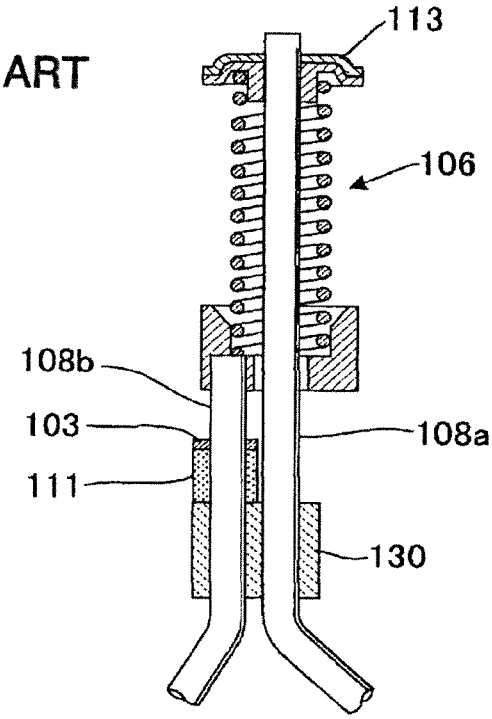
FIG. 10 PRIOR ART
FIG. 10 is a drawing showing the cathode part of the related magnetron.
Figure 11:
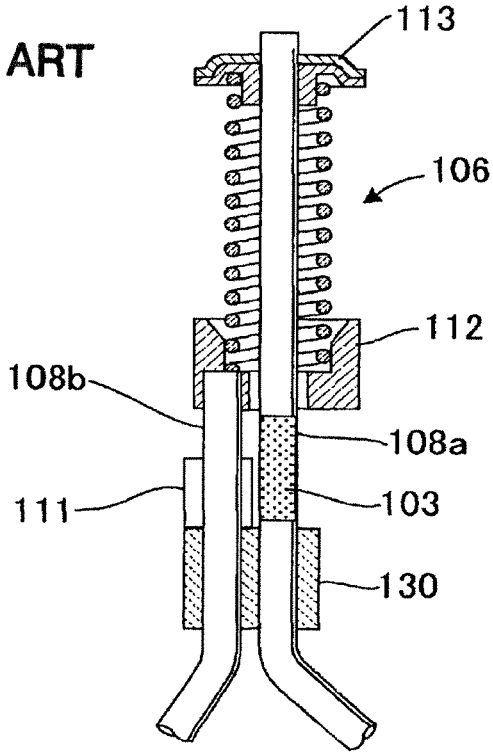
FIG. 11 PRIOR ART
FIG. 11 is a drawing showing the cathode part of the related magnetron.

Unlike the cathode lead 108*a* and 108*b* and the end hat 113 are provided (refer to FIG. 10 and FIG. 11), the mounting part 120 is not provided at a position at which the mounting part is affected by processes such as filament activation of the cathode part 106. In stead, the mounting part 120 is provided on the space between the anode vane 105 and the pole piece 121. Therefore, the getter material 103 provided on the mounting part 120 does not melt or evaporate at the time of processes such as filament activation. Especially, as the getter material is provided on the back side of the mounting part 120, the influence of high temperature thermal radiation due to processes such as filament activation can be minimized. The mounting part is disposed at the position where the vapor of the getter material hardly diffuses to the stem ceramic 107 supporting the cathode lead and to the antenna ceramic 110 at the side of the antenna lead 109 even if the getter material evaporates. Therefore, the getter material is not vapor-deposited on the stem ceramic and the antenna ceramic, and unwilling electrical conduction or performance deterioration is prevented.

Thus, according to the magnetron 1 of this embodiment, as the mounting part 120 having the getter material 103 is provided on the pole piece 121, the thermal radiation from the filament efficiently heats the getter material and the getter material is able to work in the thermal range in which the gettering effect is exerted sufficiently. In addition, the influence of processes such as filament activation is small in the space surrounded by the anode vane and the pole piece on which the mounting part 120 is mounted. Therefore, the getter material does not melt or evaporates during the processes. The mounting part is disposed at the position where the vapor of the getter material hardly diffuses to the stem ceramic 107 supporting the cathode lead 108*a* and to the antenna ceramic 110 even if the getter material evaporates. Therefore, the getter material is not vapor-deposited on the stem ceramic and the antenna ceramic, and unwilling electrical conduction or performance deterioration is prevented.

In the above described embodiment, the mounting part 120 is mounted on the pole piece 121 which is affixed to the input side opening end of the anode cylinder. However, the mounting part 120 may be mounted on the pole piece 104 which is affixed to the output side opening end of the anode cylinder.

Further, in the above described embodiment, the mounting piece 120 is formed in a plane ring shape, and the getter material 130 is provided on the back side of the mounting piece 120. Further, the mounting part 120 is mounted on the small circular plane 121*a* of the pole piece 121. However, in fact, the shape of the mounting part 120 and the position on which the mounting part 120 is mounted are not limited to this embodiment and various embodiments can be conceivable. Examples of modifications are described below.

Figure 4:
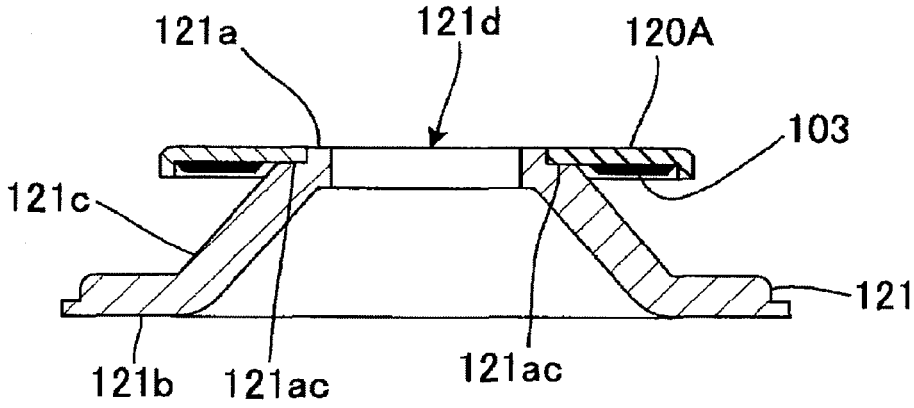
FIG. 4 is a vertical sectional view of the pole piece and one of applications of the mounting part of the magnetron according to the embodiment.

The mounting part 120A shown in FIG. 4 has an outer periphery 120Aa bended toward the pole piece 121 side at a right angle. With this configuration, even if the getter material evaporates, the area to which the getter material diffuses is limited.

Figure 5:
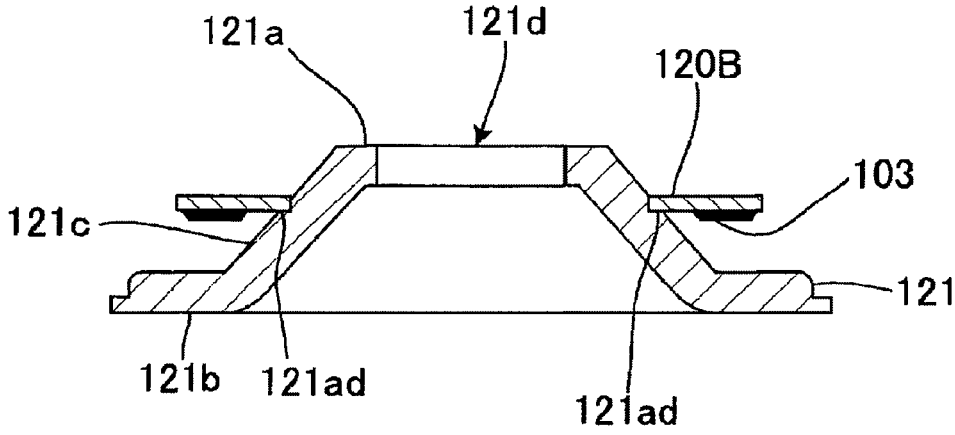
FIG. 5 is a vertical sectional view of the pole piece and one of applications of the mounting part of the magnetron according to the embodiment.

In the mounting part 120B shown in FIG. 5, the through hole 120Ba has a larger radius as compared to above embodiment so that the mounting part 120B is mounted on the middle of the inclination part of circular cone shape 121*c* of the pole piece 121. In this case, the inclination part 121*c* has a cut-out part 121*ad* along its periphery, which engages with the through hole 120Ba of the mounting part 120B. Thus, by changing the position of the mounting part, it is possible to set the mounting part at the best position for the gettering effect.

Figure 6:
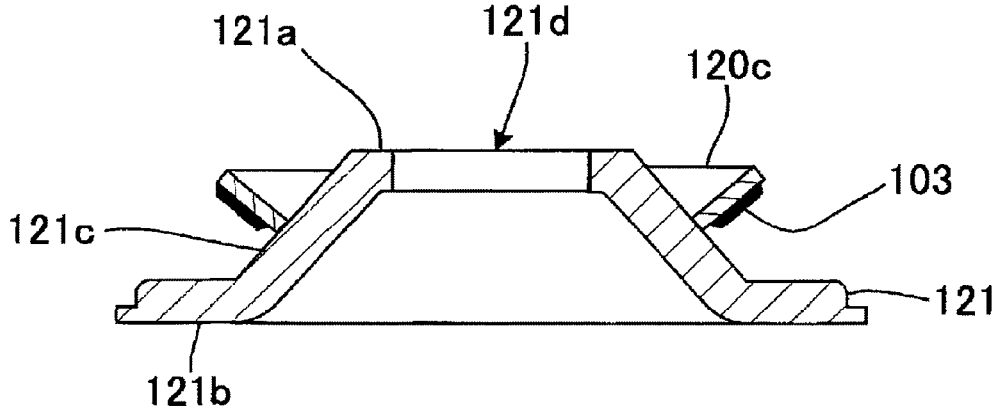
FIG. 6 is a vertical sectional view of the pole piece and one of applications of the mounting part of the magnetron according to the embodiment.

The mounting part 120C shown in FIG. 6 is formed into a tapered cylinder shape having openings at opposite ends. The one opening has a small radius and the other opening has a large radius. Thus the mounting part 120C has the getter material 103 on the outer peripheral surface. In this case, the edge of the one opening with a small radius is inclined so as to closely contact with the surface of the inclination part 121*c* of the pole piece 121. The getter material 103 is provided on the outer peripheral surface of the pole piece 121 in the peripheral direction. According to this configuration, the thermal radiation from the filament is efficiently utilized.

Figure 7:
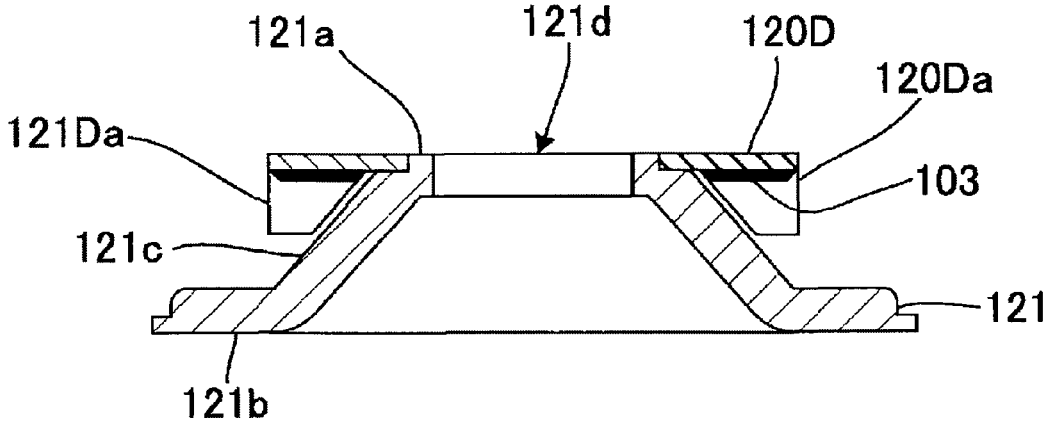
FIG. 7 is a vertical sectional view of the pole piece and one of applications of the mounting part of the magnetron according to the embodiment.
Figure 8A:
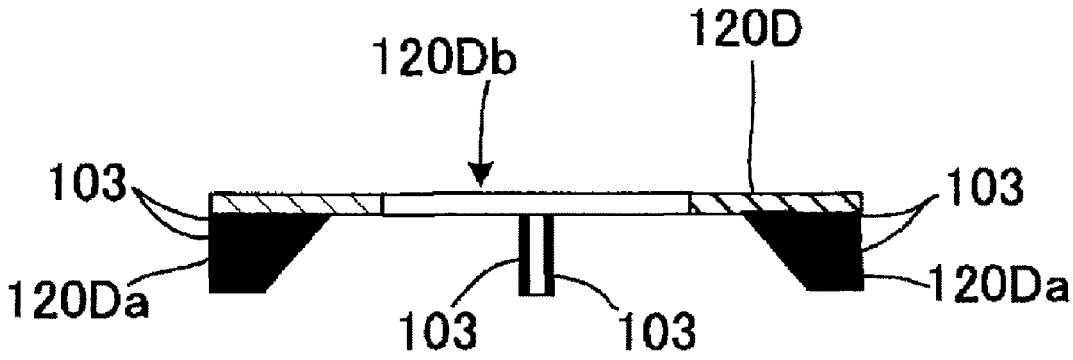
FIG. 8A is a vertical sectional view of the pole piece and one of applications of the mounting part of the magnetron according to the embodiment.
Figure 8B:
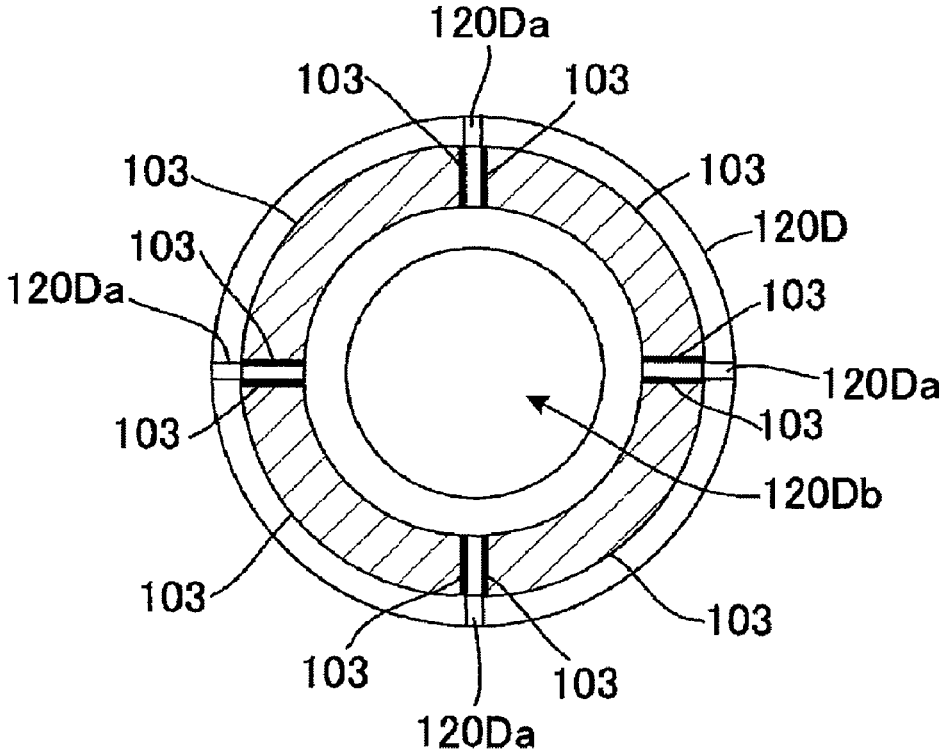
FIG. 8B is a plan view of the pole piece and one of applications of the mounting part of the magnetron according to the embodiment.

The mounting part 120D shown in FIG. 7 has four protrusions 120Da on the outside periphery of its back surface at regular intervals. FIG. 8A is a vertical sectional view of the mounting part 120D and FIG. 8B is a plan view of the back side of the mounting part 120D. As shown in FIGS. 8A and 8B, the protrusion 120Da has a thin plane shape and a trapezoid profile, and the getter material is provided on the surfaces of the protrusions. The protrusions are aimed to increase the area to which the getter material 103 is applied, and to limit the diffusion area when the getter material 103 evaporates and diffuses. The number of the protrusions is arbitrary instead of four of this example. There are other examples to increase gettering area in addition to provide the protrusions 120Da. One is to provide a concave-convex part on the surface of the mounting part. Another one is to do a surface process to the mounting part.

Applying the magnetron of the present invention to a micro wave application apparatus, high performance is achieved.

The present invention enables the getter material to work in the thermal range in which the gettering effect exerted sufficiently. In addition, even if the getter material evaporates, the getter material is not vapor-deposited to the stem ceramic or the antenna ceramic. Therefore the unwilling electrical conduction and performance deterioration are prevented.

What is claimed is:

1. A magnetron comprising:

an anode cylinder having a cylindrical shape with open side ends and including an inner wall and a plurality of anode vanes radially provided on the inner wall;

a cathode part provided on a central axis of the anode cylinder;

a pair of pole pieces, one of which is provided on the one of the open side end and the other one of which is provided on the other open side end; and a mounting part provided in the anode cylinder as a different part from the pair of pole pieces; and a getter material provided on the mounting part, wherein said getter material has a longitudinal axis which is substantially perpendicular to a central axis of said anode cylinder, and said getter material does not contact said cathode part.

2. The magnetron according to claim 1, wherein the mounting part is mounted on at least one of the pair of pole pieces.

3. The magnetron according to claim 2, wherein the mounting part is formed from a non-magnetic material.

4. The magnetron according to claim 2, wherein the mounting part has a ring-shape and the getter material is provided on a surface of the mounting part facing to the at least one of the pair of pole pieces.

5. The magnetron according to claim 4, wherein each of the pair of pole pieces has a funnel shape with a through hole.

6. The magnetron according to claim 5, wherein each of the pair of pole pieces having the funnel shape includes a small circular plane, a large circular plane, and an inclination part connecting the small circular plane and the large circular plane, wherein the through hole penetrates the small and the large circular plane.

7. The magnetron according to claim 6, wherein the mounting part is engaged with the small circular plane.

8. The magnetron according to claim 6, wherein the mounting part is engaged with the inclination part.

9. The magnetron according to claim 2, wherein the mounting part has an outer periphery bended at right angle.

10. The magnetron according to claim 2, wherein the mounting part has a plurality of protrusions on a surface of the mounting part facing to the at least one of the pair of pole pieces at regular interval.

11. The magnetron according to claim 2, wherein the at least one of the pair of pole pieces having the funnel shape includes a small circular plane, a large circular plane, and an inclination part connecting the small circular plane and the large circular plane the through hole penetrates the small and the large circular plane;

the mounting part has a tapered shape and includes a first opening with a small radius and a second opening with a large radius; and the getter material is provided on an outer peripheral surface of the mounting part .

12. The magnetron according to claim 1, wherein the mounting part is formed from a non-magnetic material.

13. A micro wave application apparatus comprising:

a magnetron according to claim 1.

14. The magnetron according to claim 1, wherein said mounting part does not contact said cathode part.

15. The magnetron according to claim 1, wherein said getter material is disposed underneath at least one of said plurality of anode vanes when viewed along an axis parallel to said central axis of said anode cylinder.

* * * * *